US012325983B2

(12) United States Patent
Tsuchie et al.

(10) Patent No.: US 12,325,983 B2
(45) Date of Patent: Jun. 10, 2025

(54) ON-SITE MONITORING APPARATUS AND ON-SITE MONITORING SYSTEM

(71) Applicant: Hitachi Construction Machinery Co., Ltd., Tokyo (JP)

(72) Inventors: Yoshiyuki Tsuchie, Tokyo (JP); Shinya Imura, Tokyo (JP); Hidekazu Moriki, Tokyo (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 787 days.

(21) Appl. No.: 17/627,437

(22) PCT Filed: May 26, 2020

(86) PCT No.: PCT/JP2020/020799
§ 371 (c)(1),
(2) Date: Jan. 14, 2022

(87) PCT Pub. No.: WO2021/038990
PCT Pub. Date: Mar. 4, 2021

(65) Prior Publication Data

US 2022/0259832 A1 Aug. 18, 2022

(30) Foreign Application Priority Data

Aug. 26, 2019 (JP) ..... 2019-153651

(51) Int. Cl.
*E02F 9/26* (2006.01)
*E02F 9/24* (2006.01)

(52) U.S. Cl.
CPC ..... *E02F 9/265* (2013.01); *E02F 9/24* (2013.01)

(58) Field of Classification Search
CPC ..... E02F 3/435; E02F 9/2033; E02F 9/2228; E02F 9/24; E02F 9/261; E02F 9/265
See application file for complete search history.

(56) References Cited

U.S. PATENT DOCUMENTS 8,810,652 B2 * 8/2014 Braune ..... F16P 3/142 348/175
10,344,450 B2 * 7/2019 Sharp ..... E02F 9/24
(Continued)

FOREIGN PATENT DOCUMENTS

JP 2003-105807 A 4/2003
JP 2017-4184 A 1/2017
(Continued)

OTHER PUBLICATIONS

International Search Report (PCT/ISA/210) issued in PCT Application No. PCT/JP2020/020799 dated Sep. 1, 2020 with English translation (five (5) pages).
(Continued)

*Primary Examiner* — Tyler J Lee
(74) *Attorney, Agent, or Firm* — Crowell & Moring LLP

(57) ABSTRACT

Provided is an on-site monitoring apparatus and an on-site monitoring system that can appropriately set an area to be subjected to on-site monitoring. The on-site monitoring apparatus includes warning devices 104 and 309 that output a warning, peripheral object detection devices 102 and 307 that detect a position of a partition object 512, work area input devices 101 and 305 that receive an input of information indicating boundaries AB and BC to be arranged with a partition object, and control devices 103 and 308. The control devices 103 and 308 includes operation environment determination sections 107 and 312 that determine, for each boundary, whether the boundary is an arranged boundary where the partition object 512 is arranged at a position corresponding to the boundary or an unarranged boundary where the partition object 512 is not arranged at a position corresponding to the boundary, and warning content determination sections 108 and 313 that output a warning by the
(Continued)

warning devices 104 and 309 when at least one unarranged boundary is present.

13 Claims, 6 Drawing Sheets

(56) References Cited

U.S. PATENT DOCUMENTS

| | | | | |
|---|---|---|---|---|
| 11,028,553 | B2 * | 6/2021 | Hashimoto | E02F 9/2033 |
| 2013/0147958 | A1 * | 6/2013 | Mitsuta | H04N 23/90 348/148 |
| 2017/0026618 | A1 * | 1/2017 | Mitsuta | H04N 7/18 |
| 2018/0347147 | A1 | 12/2018 | Doi et al. | |
| 2019/0024348 | A1 * | 1/2019 | Hiekata | E02F 9/267 |
| 2019/0277004 | A1 * | 9/2019 | Hashimoto | G01B 11/00 |
| 2020/0032489 | A1 | 1/2020 | Yamazaki et al. | |
| 2021/0079625 | A1 * | 3/2021 | Narikawa | E02F 3/435 |

FOREIGN PATENT DOCUMENTS

| | | | |
|---|---|---|---|
| JP | 2017-49792 | A | 3/2017 |
| JP | 2018-170702 | A | 11/2018 |
| JP | 2018-199989 | A | 12/2018 |
| JP | 2019-56301 | A | 4/2019 |
| WO | WO 2019/069104 | A1 | 4/2019 |
| WO | WO 2021/065430 | A1 | 4/2021 |

OTHER PUBLICATIONS

Japanese-language Written Opinion (PCT/ISA/237) issued in PCT Application No. PCT/JP2020/020799 dated Sep. 1, 2020 (three (3) pages).

Extended European Search Report issued in European Application No. 20858983.8 dated Aug. 8, 2023 (9 pages).

* cited by examiner

[FIG. 1]
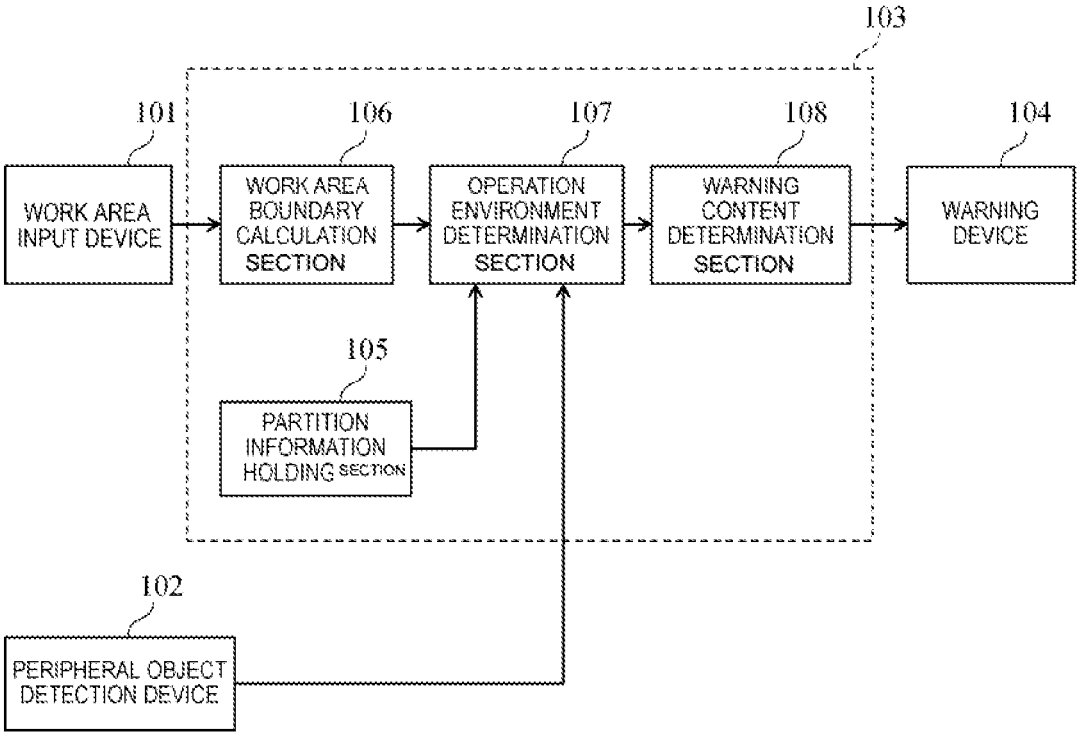

[FIG. 2]
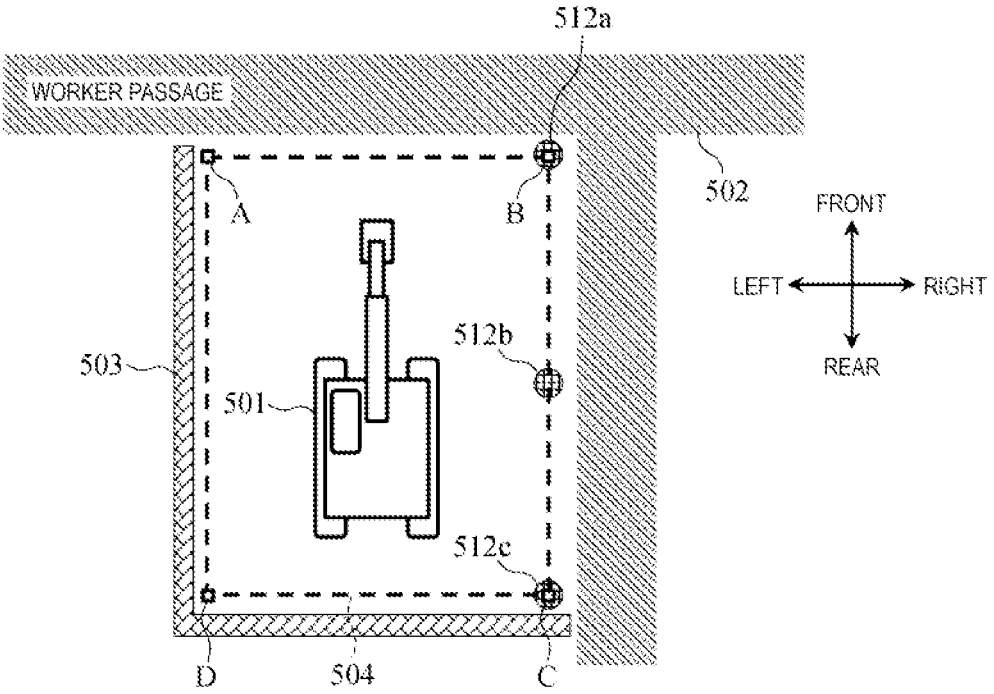
[FIG. 3]
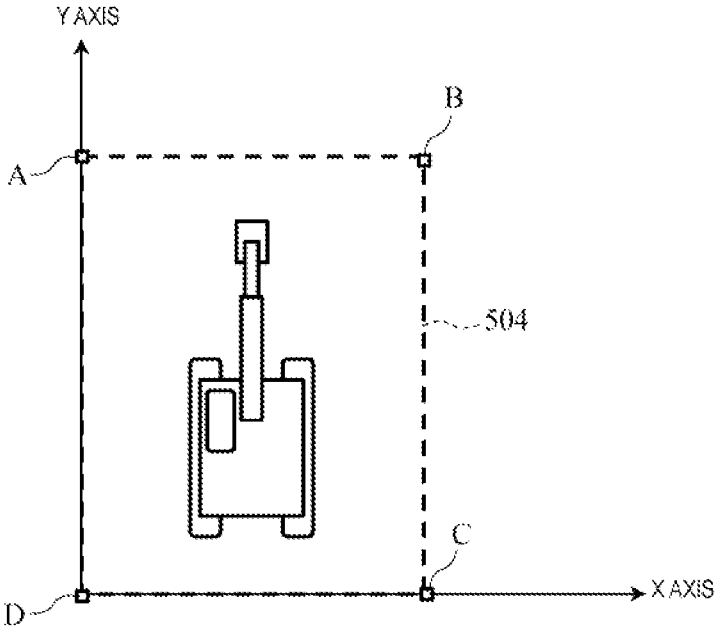

[FIG. 4]
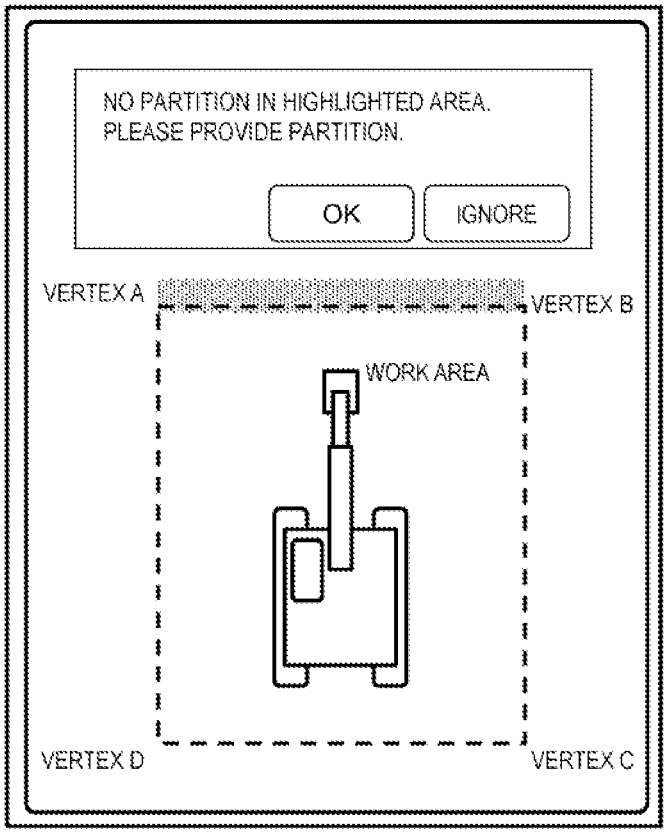
[FIG. 5]
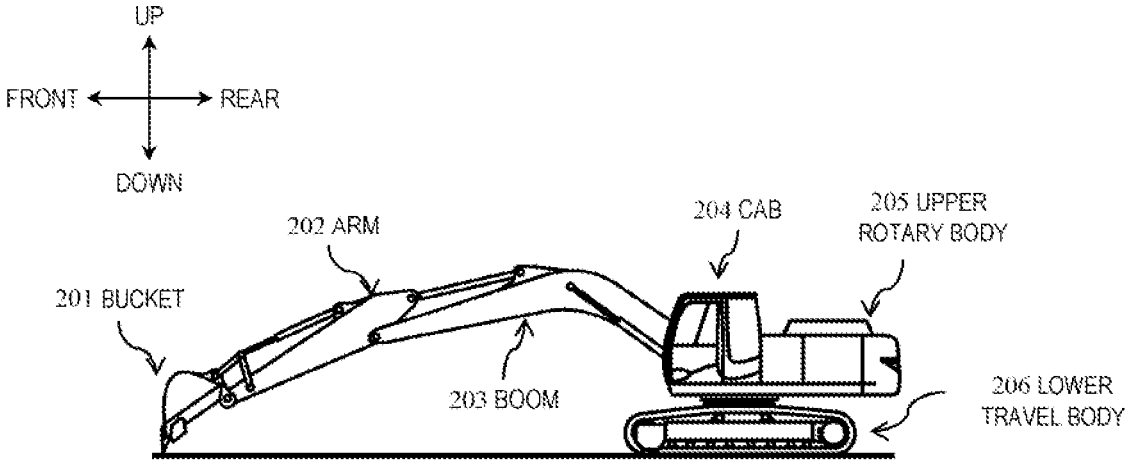

[FIG. 6]
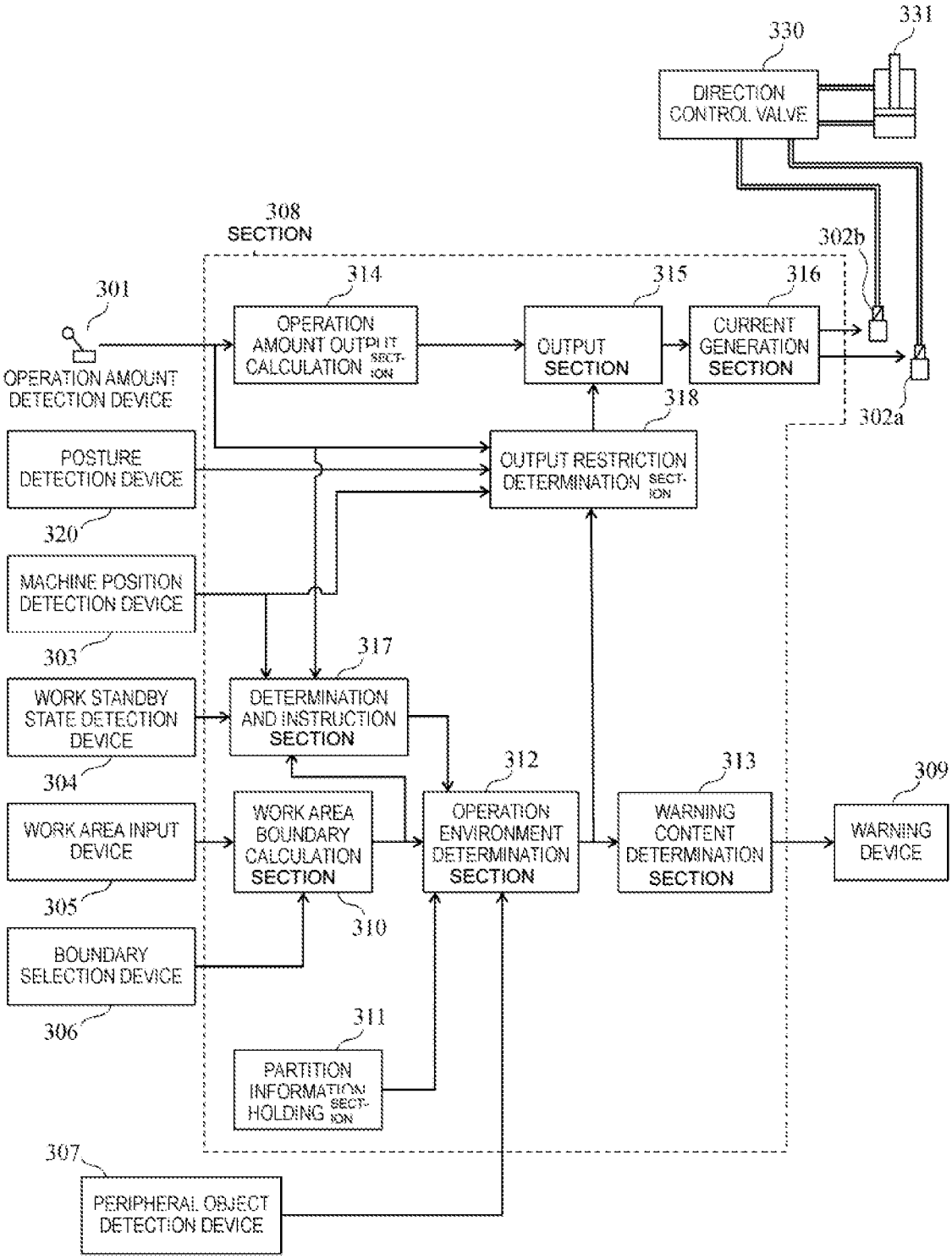

[FIG. 7]
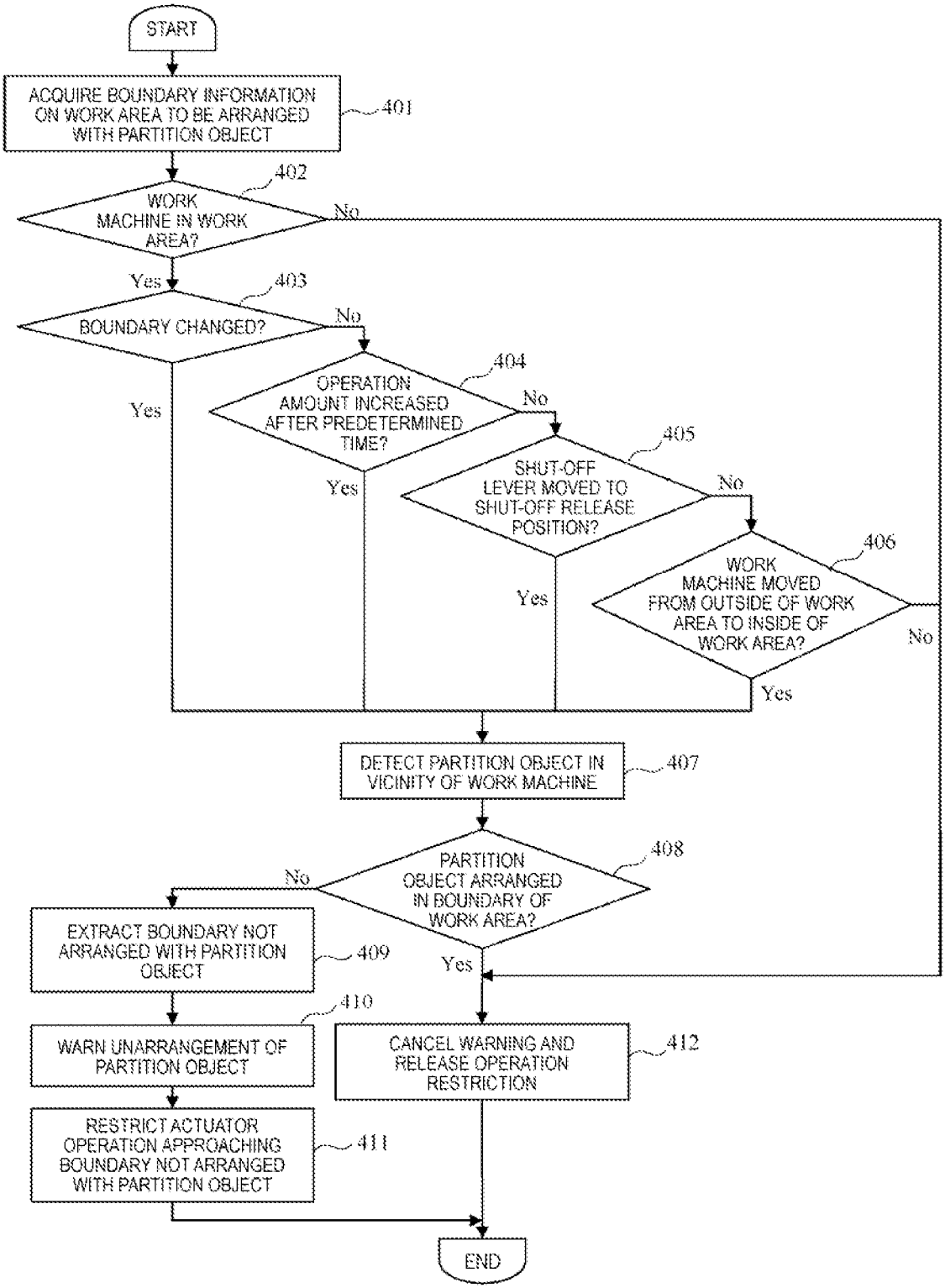

[FIG. 8]
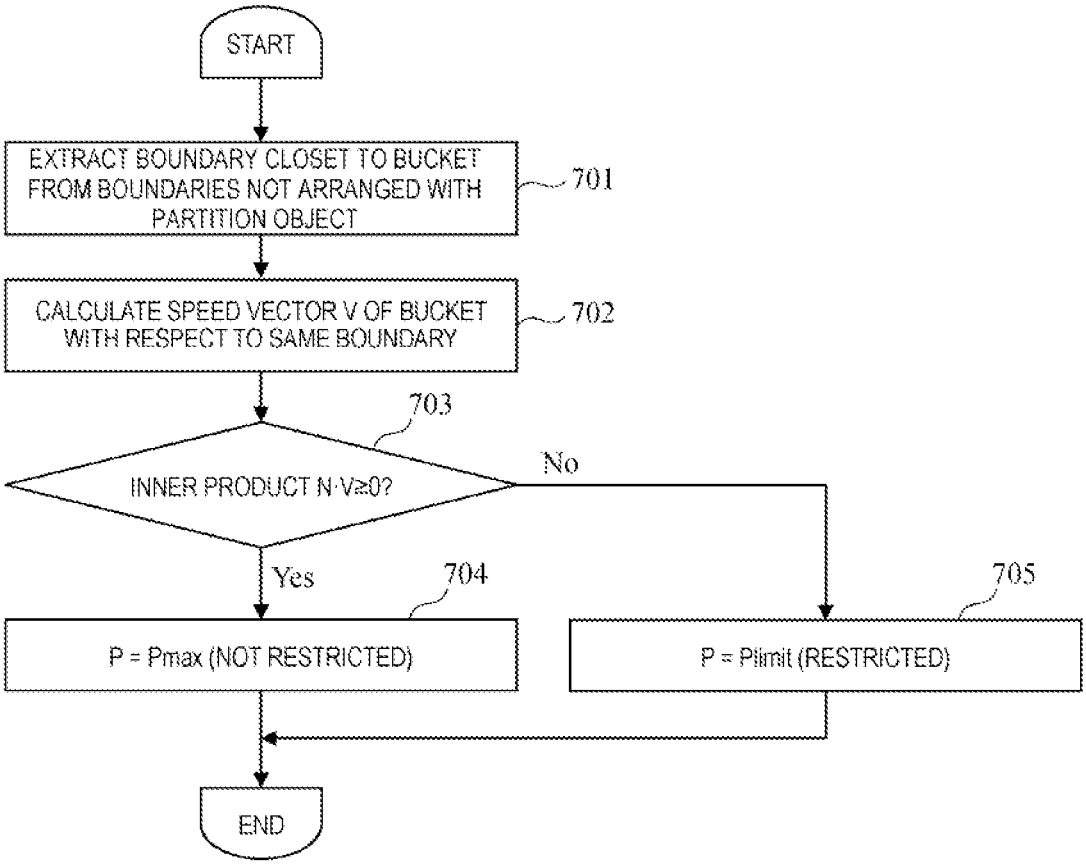
[FIG. 9]
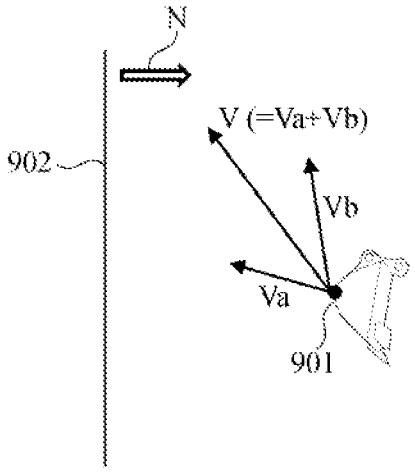

ON-SITE MONITORING APPARATUS AND ON-SITE MONITORING SYSTEM

TECHNICAL FIELD

The present invention relates to an on-site monitoring apparatus and an on-site monitoring system.

BACKGROUND ART

As a background art of the invention, a monitoring configuration for preventing contact between a work machine and a moving obstacle or the like in a work site such as a construction site is known. Techniques disclosed in Patent Literature 1 and Patent Literature 2 are specific examples.

Patent Literature 1 describes a mechanism in which a work machine detects an obstacle including a person and restricts a rotating operation according to a positional relation between the obstacle and an upper rotary body of the work machine in order to prevent contact between the work machine and the obstacle.

Meanwhile, Patent Literature 2 describes a monitoring apparatus for an intrusion-forbidden area (hereinafter, referred to as a work area) in which a person is forbidden from approaching a work machine or the like. Patent Literature 2 describes a mechanism in which, in the monitoring apparatus for the work area surrounded by a transportable object (hereinafter, referred to as a partition) for identifying the work area, an intruder is warned when a recognized partition cannot be detected or a person who is not allowed to intrude is detected in the work area.

CITATION LIST

Patent Literature

Patent Literature 1: JP-A-2018-199989
Patent Literature 2: JP-A-2017-4184

SUMMARY OF INVENTION

Technical Problem

Unfortunately, the related art has a problem that an area to be subjected to on-site monitoring cannot be appropriately set. This problem is remarkable particularly in a situation where a work environment including a work area changes from moment to moment.

For example, the technique of Patent Literature 1 works only when another moving machine or a person reaches a distance at which the moving machine or the person may come into contact with the work machine, and thus an area to be subjected to on-site monitoring cannot be set in advance, and work of the work machine may be frequently interrupted in a work site with many obstacles.

In addition, in the technique of Patent Literature 2, it is assumed that traffic cones or the like are arranged at appropriate positions in advance corresponding to the work area. Therefore, it is not possible to cope with a case where the traffic cones are not appropriately arranged or a case where the work area changes from moment to moment.

The invention is provided to solve such a problem, and an object thereof is to provide an on-site monitoring apparatus and an on-site monitoring system that can appropriately set an area to be subjected to on-site monitoring.

Solution to Problem

An example of the on-site monitoring apparatus according to the invention includes:

- a warning device configured to output a warning;
- a partition object detection device configured to detect a position of a partition object;
- a boundary input device configured to receive an input of information indicating a boundary to be arranged with a partition object; and
- a control device, in which
- the control device includes
  - a determination section configured to determine whether a boundary is an arranged boundary where the partition object is arranged at a position corresponding to the boundary or an unarranged boundary where the partition object is not arranged at a position corresponding to the boundary, and
  - a warning content determination section configured to output by the warning device the warning when at least one unarranged boundary is present.

The present description includes the disclosure of Japanese Patent Application No. 2019-153651, which is the basis of the priority of the present application.

Advantageous Effect

According to the on-site monitoring apparatus and the on-site monitoring system according to the invention, an area to be subjected to on-site monitoring can be appropriately set.

BRIEF DESCRIPTION OF DRAWINGS

FIG. 1 is a system block diagram showing a configuration of an on-site monitoring apparatus according to a first embodiment of the invention.

FIG. 2 shows an example of a work environment according to the first embodiment.

FIG. 3 shows a definition example of a coordinate system in FIG. 2.

FIG. 4 shows an example of a warning output by a warning device.

FIG. 5 shows a configuration of a work machine according to a second embodiment.

FIG. 6 is a system block diagram showing a configuration of an on-site monitoring system according to the second embodiment.

FIG. 7 is a flowchart showing an example of a process executed by an on-site monitoring system of FIG. 6.

FIG. 8 is a flowchart showing an example of a process of setting an operation restriction in step 411 of FIG. 7.

FIG. 9 shows an example of a movement of a movable portion with respect to an unarranged boundary in step 411 of FIG. 7.

DESCRIPTION OF EMBODIMENTS

Embodiments of the invention will be described below with reference to the accompanying drawings.

First Embodiment

FIG. 1 is a system block diagram showing a configuration of an on-site monitoring apparatus according to the first embodiment of the invention. The on-site monitoring apparatus is an apparatus for monitoring boundaries of a work area and outputting a warning when a partition object (triangular cone or the like) is not arranged. The on-site monitoring apparatus includes a work area input device 101, a peripheral object detection device 102, a control device 103, and a warning device 104. The control device 103 includes a partition information holding section 105, a work area boundary calculation section 106, an operation environment determination section 107, and a warning content determination section 108.

The work area input device 101 receives an input of the work area. The work area means an area to be subjected to on-site monitoring, and indicates, for example, a topographical area to be subjected to an on-site work or the like. In addition, in the present embodiment, the work area input device 101 functions as a boundary input device that receives an input of information indicating at least a boundary to be arranged with a partition object among these boundaries.

FIG. 2 shows an example of a work environment according to the first embodiment. A work machine 501 is arranged inside a work area 504. The work area 504 is a polygon, and is a rectangle defined by vertices A, B, C, and D in the example of FIG. 2. Therefore, FIG. 2 shows four boundaries, which are defined as line segments of sides AB, BC, CD, and DA, respectively. In addition, FIG. 2 shows front-rear and left-right directions with reference to the work machine 501.

In the example of FIG. 2, the work area is indicated in a two-dimensional format, and each boundary corresponds to a line segment. Alternatively, the work area may be indicated in a three-dimensional format, and in this case, each boundary may correspond to a plane segment. When the work area is indicated in a three-dimensional format, for example, the boundary corresponding to the side AB may be a plane segment including the side AB and an area vertically above the side AB.

FIG. 3 shows a definition example of a coordinate system in FIG. 2. In the example of FIG. 3, an origin of the coordinate system coincides with the vertex D, an X axis is parallel to the side CD, and a direction toward the vertex C is set as positive. In addition, a Y axis is parallel to the side DA, and a direction toward the vertex A is set as positive.

In addition, a method for defining the coordinate system may be any method. In the example of FIG. 3, a coordinate system fixed to a work site (a work site coordinate system) is used. Alternatively, a coordinate system fixed to a vehicle body of the work machine 501 (a vehicle body coordinate system) may be used, and another coordinate system may also be used. Furthermore, two-dimensional coordinates are used in the example of FIG. 3, and three-dimensional coordinates may be used, and in this case, a Z-axis may be positive in a vertically upward direction.

For example, when the boundaries are line segments, the information indicating each boundary includes information indicating positions (for example, two-dimensional coordinate values) of two ends of the boundary. As a specific example, the position of the vertex A is a coordinate (0, d), the position of the vertex B is a coordinate (w, d), the position of the vertex C is a coordinate (w, 0), and the position of the vertex D is a coordinate (0, 0). Here, d and w are both positive real numbers. In this case, positions of two ends of the side AB are input to the work area input device 101 as {(0, d), (w, d)}. The same applies to the other sides.

Practically, the work area 504 is not a plane but a three-dimensional space having a height, and the boundaries are not line segments but plane segments extending in a vertical direction. In the first embodiment, it is assumed that the working area 504 and the boundaries can be indicated by a graphic projected on a horizontal plane (that is, by two-dimensional coordinates). The coordinate may also be indicated in three dimensions.

The work machine 501 operates without going outside the work area 504. Therefore, it is assumed that while a person or the like (including a person, an obstacle, and the like. The same applies below.) is outside the work area 504, it is not possible that the person or the like would come into contact with the work machine 501.

The boundaries are classified into a boundary to be arranged with a partition object and a boundary where a partition object is unnecessary. At least one of the boundaries is a boundary to be arranged with a partition object. In the example of FIG. 2, the side AB and the side BC face a worker passage 502 where a person or the like can freely pass. Since a person or the like may erroneously enter such boundaries, a partition object is to be arranged in order to prevent such an erroneous entry. Meanwhile, walls 503 are present on the side CD and the side DA, and the walls 503 prevent a person or the like from entering. Therefore, it is unnecessary to arrange a partition object. Whether a boundary is a boundary to be arranged with a partition object can be appropriately determined by a user of the on-site monitoring apparatus or the like according to the situation.

In the example of FIG. 2, three partition objects 512 are arranged. A partition object 512*a* is arranged at the vertex B, a partition object 512*b* is arranged on the side BC, and a partition object 512*c* is arranged at the vertex C. Configurations of the partition objects may be any configuration, and for example, a known triangular cone may be used.

In the example of FIG. 2, the partition object 512 is appropriately provided on the side BC and is not arranged around a center of the side AB, which is considered to be inappropriate. Therefore, the on-site monitoring apparatus according to the present embodiment detects that the partition object 512 is not arranged on the side AB, and prompts an appropriate arrangement of the partition object 512 by issuing a warning.

The peripheral object detection device 102 detects the partition objects 512 arranged around the work site. The peripheral object detection device 102 can use, for example, an image recognition technique, and as a specific example, can combine a stereo camera and a global navigation satellite system (GNSS). Alternatively, the peripheral object detection device 102 can use a light detection and ranging technique (LIDAR or the like) or a RF technique (RFID tag or the like).

The peripheral object detection device 102 may be a partition object detection device that detects only a specific partition object 512. In this case, the partition information holding section 105 may be omitted. Alternatively, the peripheral object detection device 102 may be an object detection device that detects not only the partition object 512 but also various objects. In this case, information for identifying the partition object 512 from various objects may be stored in the partition information holding section 105. Examples of the information for identifying the partition object 512 include a shape, color, and the like of the partition object 512. By using such a partition information holding section 105, the shape, color, and the like of an object used as the partition object 512 can be flexibly selected.

The control device 103 controls an operation of the on-site monitoring apparatus. The control device 103 has, for example, a configuration as a known computer including a calculation section and a storage section. The storage section of the control device 103 may store a program that defines an operation of the control device 103. In this case, the calculation section of the control device 103 may execute this program, whereby a control section may implement functions described in the present description. When the control device 103 includes a plurality of computers, each of the computers may have the above configuration.

An arrangement location of the control device 103 may be any location. The control device 103 may be mounted on the work machine 501, may be fixed and provided at the work site, or may be portable. In addition, the control device 103 may be arranged in a distributed manner at a plurality of locations.

The warning device 104 outputs a warning. The warning includes, for example, information indicating that the partition object 512 is not appropriately arranged at the boundary of the work area 504. An arrangement location of the warning device 104 may be any location. For example, the warning device 104 may be mounted on the work machine 501, may be carried by a worker at the work site, or may be arranged at the work site.

FIG. 4 shows an example of a warning output by the warning device 104. In this example, the warning is a screen display on a display device such as a monitor. In this example, the position of each boundary is displayed, and it is indicated that the partition object 512 is not present at the boundary corresponding to the side AB. As a result, a user who views the display device can know that the partition object 512 is not appropriately arranged.

The warning device 104 can be a monitor for an operator of the work machine 501 when mounted on the work machine 501. The warning device 104 can be a monitor of an information terminal when carried by a worker. The warning device 104 can be fixed and provided at a predetermined location when arranged at the work site. By arranging the warning device 104 in this manner, a warning can be reliably transmitted. A mode of the output warning may be any mode, and may include, for example, display of a symbol, a figure, or a message by a display device, reproduction of a warning sound or a message by an audio output device, or transmission of an electronic signal by a communication device.

As described above, the partition information holding section 105 may store information for identifying the partition object 512.

The work area boundary calculation section 106 extracts a boundary to be arranged with the partition object 512 from the boundaries of the work area. For example, in the example of FIG. 2, the side AB and the side BC are extracted from the sides AB, BC, CD, and CD, which are the boundaries of the work area 504, as boundaries to be arranged with the partition object 512.

By providing the work area boundary calculation section 106, a user of the on-site monitoring apparatus can more flexibly define the boundary. For example, after inputting a rectangle ABCD as the work area, it can be specified to exclude the side CD and the side DA where walls are present.

Information required by the work area boundary calculation section 106 in order to distinguish between a boundary to be arranged with the partition object 512 and a boundary not to be arranged with the partition object 512 can be provided in any configuration. For example, the on-site monitoring system may store information indicating a construction plan. The construction plan may include a position of the wall 503, and in this case, the work area boundary calculation section 106 can automatically acquire the position of the walls 503 based on the construction plan. Alternatively, the user of the on-site monitoring apparatus may specify whether a wall is present on each side. In the example of FIG. 2, a wall is present on each of the side CD and the side DA. Therefore, it is determined that it is unnecessary to arrange the partition object 512 at these boundaries.

The operation environment determination section 107 functions as a determination section that determines whether the partition object 512 is arranged at a position corresponding to each boundary to be arranged with the partition object 512. Hereinafter, in the present description, when the partition object 512 is arranged at a position corresponding to a certain boundary, the boundary may be referred to as an "arranged boundary", otherwise (that is, when the partition object 512 is not arranged at a position corresponding to a certain boundary), the boundary may be referred to as an "unarranged boundary".

Hereinafter, an example in which the boundary and the position of the partition object 512 are indicated by two-dimensional coordinates is described, which can be appropriately expanded to an example in which the boundary and the position of the partition object 512 are indicated by three-dimensional coordinates. For example, a Z coordinate may be simply ignored, and calculation may be performed using XY coordinates alone.

A determination criterion may be designed by any method, and for example, whether the partition object 512 is present in the vicinity of two ends of the boundary (for example, within a predetermined distance from the two ends) may be used as a criterion. The predetermined distance may be set by a person skilled in the art or a user of the on-site monitoring apparatus by any method.

In the example of FIG. 2, regarding the side AB, the partition object 512 is not present in the vicinity of the vertex A. Therefore, the side AB is determined as an unarranged boundary. Meanwhile, regarding the side BC, the partition object 512*a* is present in the vicinity of the vertex B and the partition object 512*c* is present in the vicinity of the vertex C. Therefore, the side BC is determined as an arranged boundary. (As described above, the side CD and the side DA are not boundaries to be arranged with the partition object 512, and thus are not to be processed by the operation environment determination section 107 in the present embodiment.)

In addition to the partition object 512 in the vicinity of two ends of the boundary, the partition object 512 at a position other than the two ends may be considered. For example, in addition to the matter that the partition object 512 is arranged in the vicinity of two ends, when the partition object 512 is arranged at a position other than the vicinity of two ends, the boundary may be determined as an arranged boundary.

A specific determination method for the "position other than the vicinity of two ends" (hereinafter, simply referred to as the "vicinity of the center" for simplicity) can be designed by any method, and may be, for example, as follows. First, a partition object present in the vicinity of ends of any boundary among all the partition objects 512 is excluded. Regarding the remaining partition objects 512, a boundary having a shortest distance is specified. For example, in the case of the partition object 512*b* of FIG. 2, the boundary having the shortest distance is the side BC. Further, when the partition object 512 is located within a predetermined distance from the boundary or located in an outside of the work area 504, it is determined that the partition object 512 is arranged at a position other than the vicinity of two ends of the boundary.

According to such a determination method, different determination criteria can be used with the partition objects 512*a* and 512*b* in the vicinity of two ends and the partition object 512*c* in the vicinity of the center. That is, the partition objects 512*a* and 512*b* in the vicinity of two ends need to be arranged in the vicinity of two ends, and the partition object 512*c* in the vicinity of the center may be arranged at a separated position outside the area regardless of the distance to two ends. According to the above criterion, the partition object 512*c* in the vicinity of the center need to be not located at a position inside the area. As described above, strict determination can be made at two ends, and determination with a margin on the safety side can be made in the vicinity of the center.

When at least one unarranged boundary is present, the warning content determination section 108 causes the warning device 104 to output a warning. A content of the warning is, for example, as shown in FIG. 4, and includes information for identifying an unarranged boundary in this example. That is, according to the display as shown in FIG. 4, it is possible to identify that the side AB is an unarranged boundary, and the other boundaries are not unarranged boundaries. With such a warning content, the location to be arranged with the partition object 512 can be quickly known.

As described above, according to the on-site monitoring apparatus according to the first embodiment of the invention, it is determined whether a partition, which is a known object, is provided at the boundaries of the work area. If no partition is provided, a warning is output, and thus it is possible to prompt a worker at the work site to provide a partition.

In particular, since the boundaries of the work area can be appropriately input and the partition object 512 can be monitored based on the boundaries, the area to be subjected to on-site monitoring can be appropriately set. In particular, even when the work area changes from moment to moment, it is possible to cope with the change by inputting new boundary information each time.

In the first embodiment, even in a state where the work machine 501 is not arranged in the work site, the on-site monitoring apparatus can function alone. However, the on-site monitoring apparatus and the work machine 501 may constitute an on-site monitoring system.

Second Embodiment

In the second embodiment, an on-site monitoring apparatus and the work machine 501 cooperate to constitute an on-site monitoring system.

FIG. 5 shows a configuration of the work machine 501 according to the second embodiment. In this example, the work machine 501 is a shovel. The work machine 501 includes a bucket 201, an arm 202, a boom 203, a cab 204, an upper rotary body 205, and a lower travel body 206. In addition, FIG. 5 shows front-rear and up-down directions with reference to the work machine 501. The front-rear direction in FIG. 5 corresponds to the front-rear direction in FIG. 2. The cab 204 may be a part of the upper rotary body 205.

The work machine 501 includes an operation lever and an operation amount detection device (for example, an operation amount detection device 301 shown in FIG. 6) that detects an operation amount of the operation lever. The operation lever is mounted on, for example, the cab 204, and an operator of the work machine 501 can operate a plurality of actuators in a plurality of operation directions by operating the operation lever. Specifically, it is possible to perform crowding and dumping of the bucket 201, crowding and dumping of the arm 202, raising and lowering of the boom 203, right rotating and left rotating of the upper rotary body 205, forward movement, backward movement, left turning, and right turning of the lower travel body 206, and the like.

The work machine 501 includes an actuator, a direction control valve, and a pilot pressure control valve. The actuator includes a spool and moves a movable portion (for example, the bucket 201) of the work machine 501 in a plurality of operation directions. The direction control valve controls supply and discharge of a pressure oil to and from the actuator in accordance with a position of the spool. The pilot pressure control valve controls pilot pressure applied to the spool.

An operation direction of the operation lever corresponds to an operation direction of the actuator, and an inclination of the operation lever corresponds to the pilot pressure corresponding to the operation direction of the actuator. As the pilot pressure increases, the position of the spool of the direction control valve greatly deviates, and a flow rate of the pressure oil supplied to the actuator increases in a direction corresponding to the position of the spool.

A plurality of pilot pressure control valves may be arranged for one actuator, and each of the pilot pressure control valves controls the pilot pressure applied to two sides (or two ends) of the spool in order to move the spool in a direction corresponding to the operation direction of the actuator.

In addition, in order to prevent an operator from inadvertently coming into contact with the operation lever during non-operation and an unintended mechanical operation from occurring, the work machine 501 may be set to a state where the work machine 501 does not operate by an operation of the operation lever. That is, the work machine 501 can be in either an operable state where the work machine 501 can be operated by the operation of the operation lever or a work standby state where the work machine 501 cannot be operated by the operation of the operation lever.

The work machine 501 may transit from the operable state to the work standby state in response to a predetermined invalidation operation for invalidating the operation of the operation lever. For example, a shut-off lever may be mounted on the cab 204. The shut-off lever has two positions of a pilot pressure shut-off position and a shut-off release position. In a state where the operator moves the shut-off lever to the pilot pressure shut-off position, the work machine 501 is in the work standby state, and the operation of the operation lever is invalidated. Meanwhile, in a state where the shut-off lever is at the shut-off release position, the work machine 501 is in the operable state, and the shovel operates in accordance with the operation of the operation lever.

FIG. 6 is a system block diagram showing a configuration of the on-site monitoring system according to the second embodiment. The on-site monitoring system includes the operation amount detection device 301, pilot pressure control valves 302 (two valves 302*a* and 302*b* in this example), a machine position detection device 303, a work standby state detection device 304, a work area input device 305, a boundary selection device 306, a peripheral object detection device 307, a control device 308, a warning device 309, a posture detection device 320, a direction control valve 330, and an actuator 331.

The control device 308 includes a work area boundary calculation section 310, a partition information holding section 311, an operation environment determination section 312, a warning content determination section 313, an operation amount output calculation section 314, an output section 315, a current generation section 316, a determination and instruction section 317, and an output restriction determination section 318. The control device 308 controls an operation of the on-site monitoring system. The control device 308 has, for example, a configuration as a known computer including a calculation section and a storage section. The storage section of the control device 308 may store a program that defines an operation of the control device 308. In this case, the calculation section of the control device 308 may execute the program, whereby a control section may implement functions described in the present description. When the control device 308 includes a plurality of computers, each of the computers may have the above configuration.

The arrangement of each component is any arrangement, and for example, the operation amount detection device 301, the machine position detection device 303, the work standby state detection device 304, the posture detection device 320, the pilot pressure control valve 302, the direction control valve 330, and the actuator 331 are mounted on the work machine 501. In addition, for example, the work area input device 305, the boundary selection device 306, the peripheral object detection device 307, and the warning device 309 are provided in a work site to constitute an on-site monitoring apparatus. As in the first embodiment, the arrangement of the warning device 309 may be changed as needed.

For example, a part of the control device 308 is mounted on the work machine 501, and the other part of the control device 308 is provided in the work site as apart of the on-site monitoring apparatus. As a specific example, the operation amount output calculation section 314, the output section 315, and the current generation section 316 are mounted on the work machine 501, and the work area boundary calculation section 310, the partition information holding section 311, the operation environment determination section 312, the warning content determination section 313, the determination and instruction section 317, and the output restriction determination section 318 are provided in the work site to constitute the on-site monitoring apparatus.

When the control device 308 is provided in a plurality of locations in a distributed manner, a communication network for transmitting and receiving information between devices, a program for transmitting and receiving information, and the like may be provided. It can be implemented by using, for example, a known wireless communication technique.

In the second embodiment (FIG. 6), components having the same names as those in the first embodiment (FIG. 1) may have the same configurations and functions. That is, the work area input device 305, the peripheral object detection device 307, the warning device 309, the work area boundary calculation section 310, the partition information holding section 311, the operation environment determination section 312, and the warning content determination section 313 in FIG. 6 may have the same configuration and function as those of the work area input device 101, the peripheral object detection device 102, the warning device 104, the work area boundary calculation section 106, the partition information holding section 105, the operation environment determination section 107, and the warning content determination section 108 in FIG. 1, respectively. In addition, an additional function may be provided, and for example, the work area boundary calculation section 310, the operation environment determination section 312, and the warning content determination section 313 may transmit and receive information to and from other components of the control device 308.

FIG. 7 is a flowchart showing an example of a process executed by the on-site monitoring system of FIG. 2. The process is started in step 401 when the on-site monitoring system receives an input of information indicating a boundary to be arranged with the partition object 512.

For example, as described in the first embodiment with reference to FIGS. 2 and 3, information on the sides AB, BC, CD, and CD, which are the boundaries of the work area 504, is input. Thereafter, the boundary selection device 306 receives an input of information for selecting a boundary (for example, the sides AB and BC) to be arranged with the partition object 512 from these sides, and transmits the information to the work area boundary calculation section 310. In accordance with this information, the work area boundary calculation section 310 extracts the sides AB and BC, as the boundaries to be arranged with the partition object 512, from the sides AB, BC, CD, and CD.

Information input work here may be performed by an operator of the work machine 501, or may be performed by a worker or the like different from the operator in accordance with a work environment of a work site.

By providing the boundary selection device 306 and the work area boundary calculation section 310, the boundary of the work area 504 and, in particular, a boundary to be arranged with the partition object 512 can be distinguished and input. Therefore, the boundary can be flexibly defined.

However, the boundary selection device 306 may be omitted. If the boundary selection device 306 is not provided, the work area boundary calculation section 310 may extract all the boundaries of the work area 504 as the boundary to be arranged with the partition object 512.

Subsequent steps 402 to 406 are processes executed by the determination and instruction section 317. In response to the input of the information indicating the boundary by the work area input device 101 in step 401, the determination and instruction section 317 causes the operation environment determination section 312 to execute a determination process. As described below, the determination process can be appropriately executed in accordance with various situations in steps 402 to 406. For example, presence or absence of the partition object 512 can be determined in accordance with a frequency of changing the arrangement of the partition object 512 or a situation where the partition object 512 is necessary. Accordingly, an operator can be prevented from being bothered due to unnecessary and frequent determination and frequent warning.

After step 401, the on-site monitoring system determines in step 402 whether the work machine 501 is located in the work area 504. The partition object 512 is required while the work machine 501 operates in the work area 504. Therefore, it can be considered that when the work machine 501 is located outside the work area 504, it is unnecessary to determine the presence or absence of the partition object 512. According to step 402, in such a case, unnecessary determination processes can be omitted.

Whether the work machine 501 is located in the work area 504 can be determined by any method. For example, the on-site monitoring system (for example, the work area boundary calculation section 310) may calculate a normal vector that is perpendicular to each boundary and positive inside the work area 504. Here, a normal vector $N_{AB}=(0, -1)$ is calculated for the side AB, and a normal vector $N_{BC}=(-1, 0)$ is calculated for the side BC. As described above, information on the boundary can be indicated by a group of a coordinate of one end of a line segment, a coordinate of the other end of the line segment, and the normal vector of the line segment. When three-dimensional coordinates are used, the normal vector is calculated in three dimensions.

When the normal vector is used as described above, the following method can be used as an example of the determination method. First, an inner product of a vector from a position of the work machine 501 to a midpoint of the boundary and a normal vector of a boundary is calculated for each boundary. Further, a sign of the inner product is determined for each boundary. If the inner product is negative (a case of 0 may be included) for all the boundaries, it is determined that the work machine 501 is located in the work area 504. Meanwhile, if the inner product is positive (a case of 0 may be included) for any boundary, it is determined that the work machine 501 is not located in the work area 504.

This determination method is an example, and other methods may be used. In particular, if the work area 504 is input as a closed figure, the method for determining the inside and outside of the work area 504 can be appropriately designed by using a known algorithm or the like. In addition, when information indicating a boundary is input in step 401, the normal vector of each boundary may also be input.

When the work area 504 is indicated by a coordinate system fixed to a work site as in the present embodiment, the machine position detection device 303 may detect the position of the work machine 501 in the coordinate system. The machine position detection device 303 may acquire a vehicle body position by using, for example, a global navigation satellite system (GNSS) or the like. Meanwhile, when the work area 504 is defined by a relative positional relation with the work machine 501, the position of the work machine 501 may be obvious. In such a case, the machine position detection device 303 may be omitted.

When it is determined in step 402 that the work machine 501 is not located in the work area 504, the process proceeds to step 412. In this case, the determination and instruction section 317 does not cause the operation environment determination section 312 to execute the determination process (step 408 to be described later). Further, in step 412, the on-site monitoring system cancels the warning and release an operation restriction. That is, the warning output by the warning device 309 is canceled (that is, a state where the warning is not output), and the operation restriction of the work machine 501 (which will be described later with reference to step 411) is released. For example, the same process as the process in step 704 to be described later is executed.

Meanwhile, when it is determined in step 402 that the work machine 501 is located in the work area 504, the determination and instruction section 317 determines whether the boundary is changed in step 403. For example, the determination and instruction section 317 monitors outputs of the work area input device 305 and the boundary selection device 306, and determines that the boundary is changed when the work area 504 is changed or the boundary of the work area 504 to be arranged with the partition object 512 is changed after the previous execution of step 403.

When the boundary is changed, the process proceeds to step 407 to be described later. In this case, the determination and instruction section 317 causes the operation environment determination section 312 to execute the determination process (step 408 to be described later). When the boundary is changed or the like, it is necessary to move the partition object 512, and in such a case, the determination process can be reliably executed (or re-executed).

When it is determined in step 403 that the boundary is not changed, in step 404, the determination and instruction section 317 determines whether an operation amount is increased after predetermined time based on the operation amount detected by the operation amount detection device 301. For example, when a state where the operation amount is equal to or less than a predetermined threshold value (including a stopped state) continues for predetermined time or more and thereafter the operation amount exceeds a predetermined threshold value (the two threshold values may not necessarily be the same), it is determined that the operation amount is increased after the predetermined time, and otherwise, it is determined that the operation amount is not increased after the predetermined time.

When it is determined that the operation amount is increased after the predetermined time, the process proceeds to step 407 to be described later. In this case, the determination and instruction section 317 causes the operation environment determination section 312 to execute the determination process (step 408 to be described later). According to such a process, the presence or absence of the partition object 512 is determined when the work machine 501 starts to operate significantly or at a higher speed from a state where the work machine 501 operates slightly or slowly. Since a worker is likely to approach the work machine 501 that operates slightly or slowly, it is highly possible that a worker comes into contact with the work machine 501 immediately after the work machine 501 starts to operate significantly or at a high speed, and an appropriate warning can be issued in such a case by the determination in step 404.

When it is determined in step 404 that the operation amount is not increased after the predetermined time, the determination and instruction section 317 determines in step 405 whether the shut-off lever moves from the pilot pressure shut-off position to the shut-off release position. That is, it is determined whether the work machine 501 transits from the work standby state to the operable state. As a specific example, when the work machine 501 is in the work standby state when step 405 is executed last time and the work machine 501 is in the operable state when step 405 is executed this time, it is determined that the work machine 501 transits from the work standby state to the operable state. Otherwise (that is, when the work machine 501 is in the operable state when step 405 is executed last time or the work machine 501 is in the work standby state when step 405 is executed this time), it is determined that the work machine 501 does not transit from the work standby state to the operable state.

When it is determined that the work machine 501 transits from the work standby state to the operable state, the process proceeds to step 407 to be described later. In this case, the determination and instruction section 317 causes the operation environment determination section 312 to execute the determination process (step 408 to be described later). According to such a process, the presence or absence of the partition object 512 is determined when the work machine 501 starts to operate from the stopped state. Since a worker is more likely to approach the stopped work machine 501 than the operating work machine 501, it is highly possible that a worker comes into contact with the work machine 501 immediately after the work machine 501 starts to operate, and an appropriate warning can be issued in such a case by the determination in step 405.

When it is determined in step 405 that the work machine 501 does not transit from the work standby state to the operable state, the determination and instruction section 317 determines in step 406 whether the work machine 501 moves from the outside of the work area 504 to the inside of the work area 504. For example, when the work machine 501 is outside the work area 504 when step 406 is executed last time and the work machine 501 is inside the work area 504 when step 406 is executed this time, it is determined that the work machine 501 moves from the outside of the work area 504 to the inside of the work area 504. Otherwise (when the work machine 501 is in the work area 504 when step 406 is executed last time or the work machine 501 is outside the work area 504 when step 406 is executed this time), it is determined that the work machine 501 does not move.

When it is determined that the work machine 501 moves from the outside of the work area 504 to the inside of the work area 504, the process proceeds to step 407 to be described later. In this case, the determination and instruction section 317 causes the operation environment determination section 312 to execute the determination process (step 408 to be described later). According to such a process, since the determination is made at the time point when the work machine 501 enters the work area 504 in which a person or the like is present, a warning can be issued at appropriate time.

Meanwhile, when it is determined in step 406 that the work machine 501 does not move from the outside of the work area 504 to the inside of the work area 504, the process proceeds to step 412. In this case, the determination and instruction section 317 does not cause the operation environment determination section 312 to execute the determination process (step 408 to be described later). Further, in step 412, the on-site monitoring system cancels the warning and releases the operation restriction as described above.

It may be determined in step 406 whether the work machine 501 moves from the outside of the work area 504 to the inside of the work area 504 "for the first time". That is, once the process branches from step 406 to step 407, the process may always branch from step 406 to step 412 regardless of the movement of the work machine 501.

As described above, according to steps 402 to 406, since the determination and instruction section 317 gives an instruction to the operation environment determination section 312 according to various conditions or omits the instruction, flexible determination processing can be performed. In particular, an operator can be prevented from being bothered due to unnecessary and frequent determination and frequent warning. In addition, since a detection condition of a work target can be defined in more detail as compared with the related art, an adverse effect due to a change in the monitoring environment can be reduced.

In step 407, the peripheral object detection device 307 detects a position of the partition object 512. At this time, the peripheral object detection device 307 may acquire necessary information from the partition information holding section 311.

Next, in step 408, the operation environment determination section 312 determines, for each boundary, whether the boundary is an arranged boundary (a boundary where the partition object 512 is arranged at a corresponding position) or an unarranged boundary (a boundary where the partition object 512 is not arranged at a corresponding position). The determination is performed, for example, in the same manner as the operation environment determination section 107 of the first embodiment.

In step 408, when all the boundaries are arranged boundaries, the process proceeds to step 412. In step 412, the on-site monitoring system cancels the warning and releases the operation restriction as described above.

When at least one unarranged boundary is present, the process proceeds to step 409. In step 409, the operation environment determination section 312 extracts information on the unarranged boundary and outputs the extracted information to the warning content determination section 313 and the output restriction determination section 318. For example, when it is determined that the side AB is an unarranged boundary, a group of the coordinate of a vertex A, the coordinate of a vertex B, and the normal vector $N_{AB}$ is output.

Next, in step 410, the warning content determination section 313 determines a warning content to be output by the warning device 309. Accordingly, for example, a warning as shown in FIG. 4 is output.

Next, in step 411, the operation restriction of the work machine 501 is set. The operation restriction is a restriction on the operation of at least a part of the actuators. By setting the operation restriction, it is possible to strongly prompt an operator of the work machine 501 to provide the partition object 512.

A person skilled in the art could appropriately design, in the work machine 501, the operation of which actuator is restricted, which operation of the actuator is restricted, and how to restrict the operation, and an example thereof will be described below.

The posture detection device 320 detects a posture of the work machine 501. The posture detection device 320 can calculate an angle and the like of each joint based on predetermined mechanism information (for example, stored in advance) and information acquired from a sensor such as a potentiometer or an inertial measurement section (IMU). The posture of the work machine 501 is indicated by, for example, positions of one or more movable portions. The movable portion is, for example, the bucket 201 in FIG. 5, which is not limited thereto, and may include the upper rotary body 205 (or a specific portion thereof, for example, a rear end).

In addition, the posture of the work machine 501 may include a state of a part supporting the movable portion. For example, the position and orientation of the arm 202, the boom 203, the upper rotary body 205, the lower travel body 206, and the like in FIG. 5 may be included.

The operation amount output calculation section 314 determines an output value for each pilot pressure control valve based on the operation amount of the operation lever. Then, the output restriction determination section 318 determines whether the output value causes the movable portion to move in a direction approaching the unarranged boundary. The determination can be performed based on the operation direction of the operation lever and the posture of the work machine 501. In the present embodiment, when the movable portion moves in a direction approaching the unarranged boundary, the operation restriction of the work machine 501 is set.

A specific process for setting the operation restriction based on the movement of the movable portion with respect to the unarranged boundary can be appropriately designed by a person skilled in the art, and an example thereof will be described with reference to FIGS. 8 and 9.

FIG. 8 is a flowchart showing an example of a process of setting the operation restriction in step 411. FIG. 9 is a diagram showing an example of a movement of a movable portion 901 with respect to an unarranged boundary 902. In the example of FIG. 9, the movable portion 901 is the bucket 201 in FIG. 5, and the same process is also applied to the arm 202, the boom 203, the upper rotary body 205, and the lower travel body 206.

The process of FIG. 8 is started in step 701. In step 701, the output restriction determination section 318 specifies a boundary closest to the movable portion 901 from the unarranged boundaries. For example, a coordinate of the movable portion 901 is calculated and a distance to each unarranged boundary is calculated based on the information acquired from the machine position detection device 303 and the posture detection device 320. Accordingly, an unarranged boundary closest to the movable portion 901 is specified as the unarranged boundary 902. The distance may be calculated in two dimensions or may be calculated in three dimensions. When the distance is calculated in three dimensions, the boundary may be a plane segment that rises in the vertical direction from each side.

In step 702, the output restriction determination section 318 calculates a speed of the movable portion 901 with respect to the boundary specified in step 701. The speed is indicated by, for example, a two-dimensional or three-dimensional vector, and can be calculated based on predetermined fixed information (information unique to a vehicle body mechanism or the like), the operation amount of the operation lever, and the posture of the work machine 501.

In the example of FIG. 9, an operation in which two kinds of operations of arm dumping and boom raising are combined is assumed, and the speed of the movable portion 901 is indicated as a combined vector of speed vectors generated by a plurality of actuator operations. For example, an angular velocity of an arm is estimated from the operation amount of the operation lever that performs arm dumping, and a velocity vector Va given to the movable portion 901 by an arm dumping operation is calculated based on the angular velocity and the posture information. Meanwhile, a rotation angular velocity of boom raising is estimated from the operation amount of the operation lever for performing boom raising, and a velocity vector Vb given to the movable portion 901 by a boom raising operation is calculated based on the rotation angular velocity and the posture information. A velocity vector V obtained by combining the velocity vectors Va and Vb is the velocity vector of the movable portion 901.

In step 703, it is determined whether the movable portion 901 moves in a direction approaching the unarranged boundary 902. It can be determined by using, for example, the inner product of vectors. As a specific example, when the inner product of the velocity vector V of the movable portion 901 and the normal vector N of the unarranged boundary 902 (the normal vector N is directed to the inside of the work area 504) is negative, it is determined that the movable portion 901 moves in a direction approaching the unarranged boundary 902, and when the inner product is 0 or more, it is determined that the movable portion 901 does not move in a direction approaching the unarranged boundary 902.

As described above, the output restriction determination section 318 determines whether the output value determined by the operation amount output calculation section 314 causes the movable portion 901 to move in a direction approaching the unarranged boundary 902 based on the operation direction of the operation lever and the posture.

When the movable portion 901 does not move in the direction approaching the unarranged boundary 902, in step 704, the output restriction determination section 318 releases the operation restriction on all the actuators related to the operation of the movable portion 901. This is performed, for example, by setting an output upper limit value to a predetermined value Pmax (for example, a rated value or a maximum output value of the actuator). The value of Pmax may be different for each pilot pressure control valve. In the example of FIG. 9, the output of the arm dumping operation may reach Pamax, and the output of the boom raising operation may reach Pbmax.

Meanwhile, when the movable portion 901 moves in a direction approaching the unarranged boundary 902, in step 705, the output restriction determination section 318 sets the operation restriction for all the actuators related to the operation of the movable portion 901. This is performed by, for example, setting the output upper limit value to a predetermined value Plimit ($0 \leq Plimit < Pmax$). The value of Plimit may be different for each pilot pressure control valve. In the example of FIG. 9, the arm dumping operation is limited to the output Palimit or less, and the boom raising operation is limited to the output Pblimit or less.

In this way, in step 411, the operation restriction is set or released. The output section 315 outputs a control instruction for each pilot pressure control valve to the current generation section 316 based on the output upper limit value determined in step 704 or 705. In particular, when the output value determined by the operation amount output calculation section 314 does not cause the movable portion 901 to move in a direction approaching the unarranged boundary 902 or when the output value determined by the operation amount output calculation section 314 is equal to or less than the predetermined value Plimit, the control instruction is output based on the output value determined by the operation amount output calculation section 314. Meanwhile, when the output value determined by the operation amount output calculation section 314 causes the movable portion 901 to move in a direction approaching the unarranged boundary 902 or when the output value exceeds the predetermined value Plimit, a control instruction is output based on the predetermined value Plimit. The current generation section 316 receives the control instruction and generates a current for driving the pilot pressure control valve according to the control instruction.

When a person or the like is present in the work area 504, it is highly possible that the person or the like is present between the movable portion 901 and the closest unarranged boundary 902. According to the present embodiment, since the speed at which the movable portion 901 moves toward the closest unarranged boundary 902 can be limited, the contact between the movable portion 901 and a person or the like can be reliably prevented.

[Other Modifications]

In the first and second embodiments described above, the following modifications can be made.

In the second embodiment, in step 411, the operation restriction is set in accordance with the moving direction of the movable portion. As a modification, the operation restriction may be set regardless of the moving direction of the movable portion. Specifically, when an unarranged boundary is present, the output upper limit value may be always set to the predetermined value Plimit. That is, in this modification, an output section outputs a control instruction based on an output value determined by the operation amount output calculation section 314 when no unarranged boundary is present or when the output value determined by the operation amount output calculation section 314 is equal to or less than the Plimit, and outputs a control instruction based on the Plimit when at least one unarranged boundary is present and the output value determined by the operation amount output calculation section 314 exceeds the Plimit. A flowchart in this case is not particularly shown as an independent diagram, and can be configured merely by step 705 of FIG. 8.

In the second embodiment, when a part of the process is omitted, a configuration corresponding to the first embodiment is obtained. For example, steps 401, 407 to 410, and 412 in FIG. 7 constitute the process of the first embodiment.

In the first and second embodiments, the work area input devices 101 and 305 receive the input of the information indicating not only the boundary to be arranged with the partition object 512 but also all the boundaries. As a modification, a work area input device may receive an input merely for a boundary to be arranged with a partition object. In this case, the work area boundary calculation sections 106 and 310 and the boundary selection device 306 may be omitted.

The content of the warning is not limited to that shown in FIG. 4. For example, information for identifying a boundary may not be included. Even when merely a message or a warning sound indicating that a partition object is not appropriately arranged is used, reconfirmation of an arrangement of the partition object can be prompted.

It is unnecessary to provide a determination and instruction section as a single component. In the example of the second embodiment (FIG. 7), the single determination and instruction section 317 performs all the determinations in steps 402 to 406. Alternatively, as a modification, independent determination and instruction sections may be provided to correspond to steps 402 to 406.

REFERENCE SIGN LIST

101, 305 work area input device (boundary input device)
102, 307 peripheral object detection device (partition object detection device, object detection device)
103, 308 control device
104, 309 warning device
105, 311 partition information holding section
106, 310 work area boundary calculation section
107, 312 operation environment determination section (determination section)
108, 313 warning content determination section
201 bucket (movable portion)
202 arm (movable portion)
203 boom (movable portion)
204 cab
205 upper rotary body (movable portion)
206 lower travel body (movable portion)
301 operation amount detection device
302 (302*a*, 302*b*) pilot pressure control valve
303 machine position detection device
304 work standby state detection device
306 boundary selection device
314 operation amount output calculation section
315 output section
316 current generation section
317 determination and instruction section
318 output restriction determination section
320 posture detection device
330 direction control valve
331 actuator
501 work machine
502 worker passage
503 wall
504 work area
512 (512*a*, 512*b*, 512*c*) partition object
901 movable portion
902 unarranged boundary
AB, BC side (boundary to be arranged with partition object)
CD, DA side (boundary)
N normal vector of boundary
V speed vector All publications, patents, and patent applications cited in the present description are incorporated in the present description by being cited as they are.

The invention claimed is:

1. An on-site monitoring apparatus comprising:
a monitor configured to display a visual warning to a user;
a work cone detector configured to detect a position of a work cone by combining stereo camera information with global navigation satellite system information or LIDAR information or RFID information;
a work area input device configured to receive an input of information indicating a boundary to be arranged with a work cone; and
a control device that controls an operation of the on-site monitoring apparatus, wherein
the control device is mountable on a work machine, is fixable to a work site, or is portable, and includes:
a determination section configured to determine whether a boundary is an arranged boundary where the work cone is arranged at a position corresponding to the boundary or an unarranged boundary where the work cone is not arranged at a position corresponding to the boundary, and
a warning content determination section configured to output, with the monitor, the warning to the user, so as to inform the user that at least one unarranged boundary is present.

2. The on-site monitoring apparatus according to claim 1, wherein
the control device includes a determination and instruction section configured to execute by the determination section a determination process in response to the input of the information indicating the boundary by the work area input device.

3. The on-site monitoring apparatus according to claim 1, wherein
the work area input device receives an input of a work area, and
the control device includes a work area boundary calculation section configured to extract the boundary to be arranged with the work cone from boundaries of the work area.

4. The on-site monitoring apparatus according to claim 3 further comprising:
a machine position detection device configured to detect a position of a work machine, wherein
the control device includes a determination and instruction section configured to execute by the determination section a determination process, and
the determination and instruction section does not execute by the determination section the determination process when the work machine is not located in the work area.

5. The on-site monitoring apparatus according to claim 4, wherein
the determination and instruction section executes by the determination section the determination process when the work machine moves from outside of the work area to inside of the work area.

6. The on-site monitoring apparatus according to claim 3 further comprising:
a boundary selection device configured to receive an input of information for selecting the boundary to be arranged with the work cone from the boundaries of the work area.

7. The on-site monitoring apparatus according to claim 1, wherein the monitor is mounted on a work machine or arranged at a work site.

8. The on-site monitoring apparatus according to claim 1, wherein the work cone detector is an object detection device configured to detect an object, and the control device includes a partition information holding section configured to store information for identifying the work cone.

9. The on-site monitoring apparatus according to claim 1, wherein the warning includes information for identifying the unarranged boundary.

10. An on-site monitoring system comprising:

the on-site monitoring apparatus according to claim 1; and a work machine, wherein the work machine includes an operation lever and an operation amount detection device configured to detect an operation amount of the operation lever, and the control device includes a determination and instruction section configured to execute by the determination section a determination process when the operation amount exceeds a predetermined threshold value after a state where the operation amount is equal to or less than a predetermined threshold value continues for predetermined time or more.

11. An on-site monitoring system comprising:

the on-site monitoring apparatus according to claim 1; and a work machine, wherein the work machine includes an operation lever, the work machine is configured to be in either an operable state where the work machine is operable by an operation of the operation lever or a work standby state where the work machine is not operable by the operation of the operation lever, and the control device includes a determination and instruction section configured to execute by the determination section a determination process when the work machine transits from the work standby state to the operable state.

12. An on-site monitoring system comprising:

the on-site monitoring apparatus according to claim 1; and a work machine, wherein the work machine includes an operation lever, an operation amount detection device configured to detect an operation amount of the operation lever, and a pilot pressure control valve configured to control pilot pressure applied to a spool of an actuator, the control device includes an operation amount output calculation section configured to determine an output value for the pilot pressure control valve based on the operation amount, an output section configured to output a control instruction for the pilot pressure control valve, and a current generation section configured to generate a current for driving the pilot pressure control valve according to the control instruction, and the output section is configured to output the control instruction based on the output value determined by the operation amount output calculation section when the unarranged boundary is not present or when the output value determined by the operation amount output calculation section is equal to or less than a predetermined output upper limit, and output the control instruction based on the predetermined output upper limit when at least one unarranged boundary is present and the output value determined by the operation amount output calculation section exceeds the predetermined output upper limit.

13. An on-site monitoring system comprising:

the on-site monitoring apparatus according to claim 1; and a work machine, wherein the work machine includes an operation lever, an operation amount detection device configured to detect an operation amount of the operation lever, a movable portion, an actuator configured to cause the movable portion to move in a plurality of operation directions, a posture detection device configured to detect a posture of the work machine, and a plurality of pilot pressure control valves configured to control pilot pressure applied to two sides of a spool in order to move the spool in a direction corresponding to the operation direction of the actuator, the control device includes an operation amount output calculation section configured to determine an output value for each pilot pressure control valve based on the operation amount, an output section configured to output a control instruction for each pilot pressure control valve, an output restriction determination section configured to determine whether the output value determined by the operation amount output calculation section moves the movable portion in a direction approaching the unarranged boundary based on the operation direction of the operation lever and the posture, and a current generation section configured to generate a current for driving the pilot pressure control valves according to the control instruction, and the output section is configured to output the control instruction based on the output value determined by the operation amount output calculation section when the output value determined by the operation amount output calculation section does not move the movable portion in a direction approaching the unarranged boundary or when the output value determined by the operation amount output calculation section is equal to or less than a predetermined output upper limit, and output the control instruction based on the predetermined output upper limit when the output value determined by the operation amount output calculation section moves the movable portion in a direction approaching the unarranged boundary and the output value determined by the operation amount output calculation section exceeds the predetermined output upper limit.

* * * * *